US009653793B2

(12) United States Patent
Tawk et al.

(10) Patent No.: US 9,653,793 B2
(45) Date of Patent: May 16, 2017

(54) SYSTEMS AND METHODS FOR RECONFIGURABLE FILTENNA

(71) Applicant: STC.UNM, Albuquerque, NM (US)

(72) Inventors: Youssef A Tawk, Albuquerque, NM (US); Christos G Christodoulou, Albuquerque, NM (US); Joseph Costantine, Fullerton, CA (US); Maria Elizabeth Zamudio Moreno, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 113 days.

(21) Appl. No.: 14/373,974

(22) PCT Filed: Mar. 15, 2013

(86) PCT No.: PCT/US2013/032482

§ 371 (c)(1),
(2) Date: Jul. 23, 2014

(87) PCT Pub. No.: WO2013/138775

PCT Pub. Date: Sep. 19, 2013

(65) Prior Publication Data

US 2015/0054709 A1 Feb. 26, 2015

Related U.S. Application Data

(60) Provisional application No. 61/611,848, filed on Mar. 16, 2012.

(51) Int. Cl.
*H01Q 1/50* (2006.01)
*H01Q 15/24* (2006.01)
(Continued)

(52) U.S. Cl.
CPC ..... *H01Q 1/50* (2013.01); *H01Q 1/24* (2013.01); *H01Q 13/085* (2013.01); *H01Q 15/24* (2013.01)

(58) Field of Classification Search
CPC ..... H01Q 1/50; H01Q 1/24; H01Q 15/24; H01Q 13/085
See application file for complete search history.

(56) References Cited

U.S. PATENT DOCUMENTS 4,541,120 A * 9/1985 Szabo ..... H03B 9/141 331/107 SL
5,486,832 A * 1/1996 Hulderman ..... G01S 7/032 342/175

(Continued)

OTHER PUBLICATIONS

"Vivaldi Antenna with Integrated Switchable Band Oass Resonator", M. R. Hamid, Peter Gardner, IEEE Transactions on Antennas and Propagation, vol. 59, No. 11, Nov. 2011, pp. 4008-4015.*

(Continued)

*Primary Examiner* — Trinh Dinh
(74) *Attorney, Agent, or Firm* — MH2 Technology Law Group LLP

(57) ABSTRACT

Embodiments relate to systems and methods for a frequency reconfigurable filtenna system. Implementations incorporate a reconfigurable band-pass filter within the feeding line of an antenna structure. The combination of the filter and the antenna may be referred to as a "filtenna". Implementations integrate both the band-pass filter and the antenna within the same substrate, permitting easier, more efficient and more compact integration in the transceiver hardware. Moreover, by using this configuration, the biasing of the switching elements are not present in the radiating plane of the antenna. This reduces the negative effect of the biasing lines on the antenna radiation performance, as we!! as provides a tunable filtered antenna radiation characteristic.

16 Claims, 7 Drawing Sheets

(51) Int. Cl.
*H01Q 13/08* (2006.01)
*H01Q 1/24* (2006.01)

(56) References Cited

U.S. PATENT DOCUMENTS

| | | | | |
|---|---|---|---|---|
| 5,736,908 | A * | 4/1998 | Alexanian | H01P 5/12 330/286 |
| 2004/0008145 | A1* | 1/2004 | Killen | H01Q 15/0053 343/753 |
| 2005/0285809 | A1* | 12/2005 | Louzir | H01Q 13/085 343/770 |
| 2007/0171140 | A1* | 7/2007 | Minard | H01Q 1/2275 343/770 |
| 2008/0169995 | A1* | 7/2008 | du Toit | H01P 5/028 343/861 |
| 2009/0121951 | A1 | 5/2009 | Kaneda | |
| 2009/0207091 | A1* | 8/2009 | Anagnostou | H01Q 9/285 343/876 |
| 2011/0163161 | A1* | 7/2011 | Tiggelman | G06K 7/0008 235/439 |

OTHER PUBLICATIONS

International Search Report dated Jun. 28, 2013 from International Application No. PCT/US2013/032482, pp. 1-11.

Maria Elizabeth Zamudio Moreno. Reconfigurable Filtenna for Cognitive Radio Applications. Master of Science Electrical Engineering in the University of New Mexico, Dec. 2011, pp. 6-8 and 26-48, 66pgs.

Xavier Artiga et al. Halved Vivaldi Antenna With Reconfigurable Band Rejection. Antennas and Wireless Propagation Letters, IEEE, Jan. 28, 2011, vol. 10, pp. 56-58.

Jason Leo Durbin. Filtenna Using Ultra-Wideband Fed Varactor Tuned Frequency Selective Surface. Master of Science Electrical Engineering in the Texas Tech University, Aug. 2011, pp. 10-20, 72 pgs.

Symeon Mikolaou et al. Design and Development of an Annular Slot Antenna (ASA) with a Reconfigurable Radiation Pattern. Microwave Conference Proceedings, Dec. 4-7, 2005. vol. 5, pp. 1-2, 3 pgs.

* cited by examiner

SYSTEMS AND METHODS FOR RECONFIGURABLE FILTENNA

CROSS REFERENCE TO RELATED APPLICATIONS

The present application is a U.S. National Stage application of PCT/US2013/032482 filed Mar. 15, 2013 which claims priority to U.S. Provisional Application No. 61/611,848, entitled "Reconfigurable Filtenna," filed on Mar. 16, 2012, by the same inventors herein, which applications are incorporated by reference in their entireties.

GOVERNMENT FUNDING

This invention was made with Government support under Contract FA9453-09-C-0309 awarded by the United States Air Force. The Government has certain rights in the invention.

FIELD

The present teachings relate to systems and methods for a frequency reconfigurable filtenna structure, in which the operating frequency of an antenna is changed without incorporating active components on the antenna radiating surface

BACKGROUND

With the advancement in cellular and other wireless communications, there is a significant demand to implement antennas that are "smart" in the sense of being able to tune their operating characteristics (frequency, polarization, radiation pattern, etc) according to the ever-changing wireless communication requirements. Using multiple dedicated antennas to cover a variety of different wireless services that may be scattered over a wide frequency bands increases the system cost, the space requirements for the antennas, and their isolation. Reconfigurable antennas are therefore potential candidates for future RF front-end solutions to minimize the number of antennas required in a particular system.

Reconfigurable antennas have been studied in the wireless communication industry throughout the last two decades or longer. This type of antennas requires some type of reconfiguring element to change the antenna's electrical properties for each channel or communication standard.

Conventional electrically reconfigurable antennas use RF-MEMS, PIN diodes, or varactors to reconfigure their structures and create the required tuning in the antenna function. The activation and de-activation of these switching elements require the incorporation of biasing lines in the radiating plane of the antenna. The switching elements can introduce interference that disturbs the antenna electromagnetic performance. The effects of that interference need to be minimized and the placement of the reconfiguring component needs to be optimized.

The interference effects manifest themselves, first, as unwanted resonances in the operating bands of the antenna. Second the switching interference can cause a change in the antenna radiation pattern away from the design requirements, especially if the biasing lines are not designed properly. To avoid some of these difficulties, and to satisfy the design constraints, reconfigurable antennas can be designed with external matching networks or with reconfiguring elements outside the antenna radiating plane.

On the other hand, some researchers have resorted to optical switches to solve the problems and limitations produced in the electrically reconfigurable antennas. For example, n-type silicon material can be used as a switching element to tune the antenna parameters. One limitation of this technique is the integration of laser diodes within the antenna structure for the switch activation mechanism which adds to the bulkiness of the structure and increases the power consumption of the whole system. Reconfigurable antennas have also been designed using a physical change in the antenna radiating structure. For example, a stepper motor has been proposed to rotate the radiating surface of a microstrip antenna, and for each rotation a different radiating structure is fed. A significant limitation of this technique is the lack of tuning speed.

In addition to reconfigurable antennas, reconfigurable band-pass and band-stop microwave filters have been also investigated as stand-alone components. RF-MEMs, PIN diodes and varactors have been proposed mainly to tune the bandwidth of a filter. However, the non-linearity produced by the switching elements as well as the filter's insertion loss need to be addressed. It may be desirable to provide methods and systems for reconfigurable antennas to, selectively reconfigure their operation without introducing interference, or other issues.

DESCRIPTION OF DRAWINGS

The accompanying drawings, which are incorporated in and constitute a part of this specification, illustrate embodiments of the present teachings and together with the description, serve to explain the principles of the present teachings. In the figures.

DESCRIPTION OF EMBODIMENTS

Embodiments of the present teachings relate to systems and methods for a reconfigurable combination of a filter and antenna, referred to herein as a "filtering antenna" or "filtenna," having enhanced filtering and radiation performance. The inventive filtenna design can be implemented by integrating a reconfigurable band-pass or band-stop filter structure directly within the feeding line of a wideband antenna. The filter structure can utilize a varactor incorporated directly on the same substrate of the planar wideband antenna. The varactor is biased or driven by injecting a direct current (DC) signal into the microstrip feeding line through a bias tee circuit. Thus, the filter is tuned by varying the DC voltage supply. Accordingly the antenna tunes its frequency based on the filter's frequency tuning operation. The overall filtering antenna structure as noted combines both the reconfigurable filter and the antenna structure into the same substrate, which further allows easier integration in a complete RF front-end for cellular or other wireless applications. Implementations described herein do not resort to switching components incorporated on the antenna radiating structure that can affect the antenna total radiation pattern, or introduce other undesirable radio frequency behaviors in the wireless device.

Reference will now be made in detail to exemplary embodiments of the present teachings, which are illustrated in the accompanying drawings. Where possible the same reference numbers will be used throughout the drawings to refer to the same or like parts.

Figure 1:
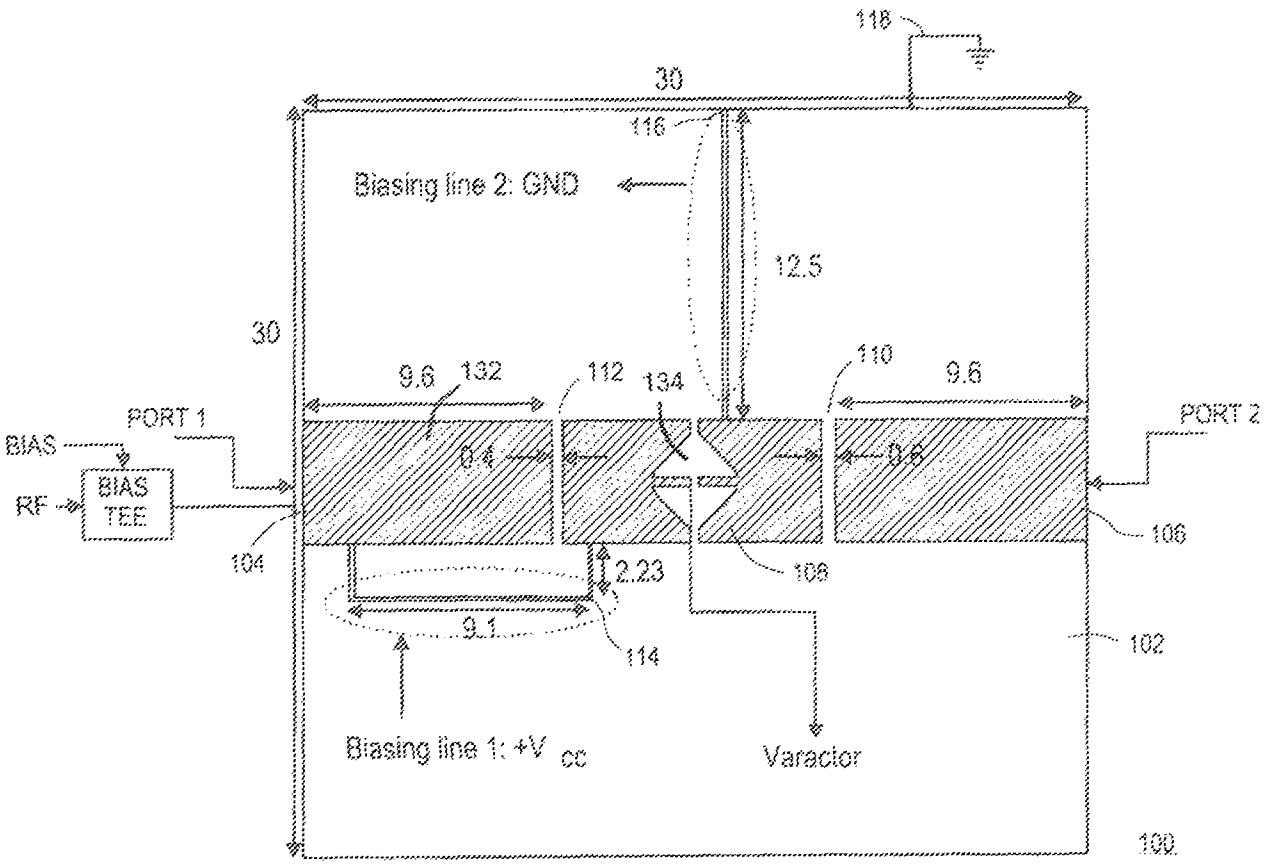
FIG. 1 illustrates an overall filter structure which can be used in systems and methods for reconfigurable antenna, according to various embodiments.

An overall filter structure 100 according to implementations of the present teachings is shown in FIG. 1, The microstrip feeding line 132 of the filter structure 100 is composed of three sections. The two outer sections are illustratively shown as having a length of 9.6 mm and a width of 5 mm, which corresponds to an impedance of 50 ohms. At a first end and a second end, a port 104 (Port 1) and a port 106 (Port 2) are respectively configured. A hexagonal slot 134 is etched in the center of the third and middle section of the microstrip feeding line 132, in the substrate 102 of the filter structure 100. A varactor 108 is incorporated inside the hexagonal slot 134, to achieve a variable capacitive connection between the two terminals in the slot of the middle section of the microstrip feeding line 132. The middle section is separated from the two outer sections of the microstrip feeding line 132 by two gaps, having illustrative widths of 0.4 mm (112) and 0.6 mm (110) respectively. These gaps contribute a fixed capacitance to the overall microstrip feeding line 132, and allow the filter structure 100 to have the desired band-pass operation. Thus different gap dimensions result in different band-pass behavior. By supplying different voltage levels to the varactor 108 using the biasing line 114, the total capacitance of the filter structure 100 changes accordingly, allowing the filter structure 100 to be tuned to various operating frequencies.

According to implementations, the filter structure 100 and related elements are printed on a commercially available Taconic TLY substrate available from Taconic, Petersburgh, N.Y., as the substrate 102, with a dielectric constant of 2.2 and a thickness of 1.6 mm, although it will be appreciated that other materials and dimensions can be used for an alternative performance. The total dimensions of the illustrative filter structure 100 are 30 mm×30 mm, although it will again be appreciated that the dimensions are merely exemplary, and others can be used for other frequency ranges. The reconfigurability of the filter structure 100 is achieved by incorporating the varactor 108 directly within its structure, as an integrated element. The varactor 108 in turn can be biased while eliminating the need for external DC wires attached to the filter structure 100, through the use of an external bias tee 120 at input port 104 of the filter structure 100.

The purpose of the bias tee 120 is to feed the filter structure 100 with the desired RF signal, while also providing the required DC voltage to drive the capacitance value of the varactor 108. Since the outer section of the filter structure 100 where the DC voltage is fed is separated from the inner section where the varactor 108 resides by the 0.4 mm gap, a biasing line 114 is needed to provide a connection between the two sections and allow the DC voltage to be supplied to one end of the varactor 108. Biasing line 114 (labeled Biasing line 1) shown in FIG. 1 has an illustrative width of 0.1 mm, which corresponds to a high impedance line. The biasing line 114 has an illustrative length of 13.56 mm, which corresponds to $\lambda g/2$ at f=7.45 GHz. Moreover in order to have a continuous voltage path through the varactor 108, the other end of the varactor 108 should be grounded. Biasing line 116 (labeled as Biasing line 2), shown in FIG. 1, connects the second end of the varactor 108 to the ground plane 118 of the filter structure 100. The biasing line 116 has an illustrative width of 0.1 mm and a length of 12.5 mm, which corresponds $\lambda g/2$ at f=8.1 GHz. The connection to the ground 118 can be done by soldering a wire from the biasing line 116 to the ground of the filter. An illustrative commercially available varactor that can be as varactor 108 is the SMV 1405 from Skyworks Solutions Inc., Woburn, Mass., while an illustrative commercially available bias tee 120 is the BT-V000-HS from United Microelectronics Corp. Sunnyvale, Calif.

Figure 2:
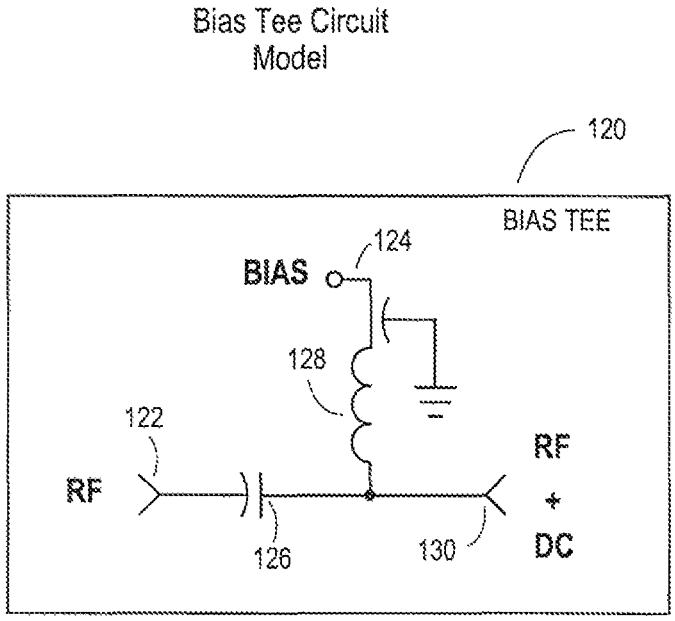
FIG. 2 illustrates a bias tee circuit or module that can be incorporated in systems and methods for reconfigurable antenna, according to various embodiments.

FIG. 2 illustrates an internal structure of the bias tee 120 that can be used in implementations of the present teachings. The bias tee can be connected to port 104 (Port 1) of the filter structure 100. At the input of the bias tee 120, the RF signal 122 is fed. The DC voltage is supplied at the bias input 124. At the output of the bias tee the RF and the DC signals are present simultaneously in output signal 130, which is fed to port 104 of the filter structure 100. The bias tee is also composed of a capacitor 126 to block the DC voltage to go to 122, and an inductor 128 to block the RF signal to leak to the DC power supply. The path of the voltage that is responsible to change the capacitance of the varactor 108, and hence tune the operating band of the filter structure 100, travels into port 104 via bias tee 120, across bias line 114 and ultimately to ground 118 via biasing line 116.

Figure 3A:
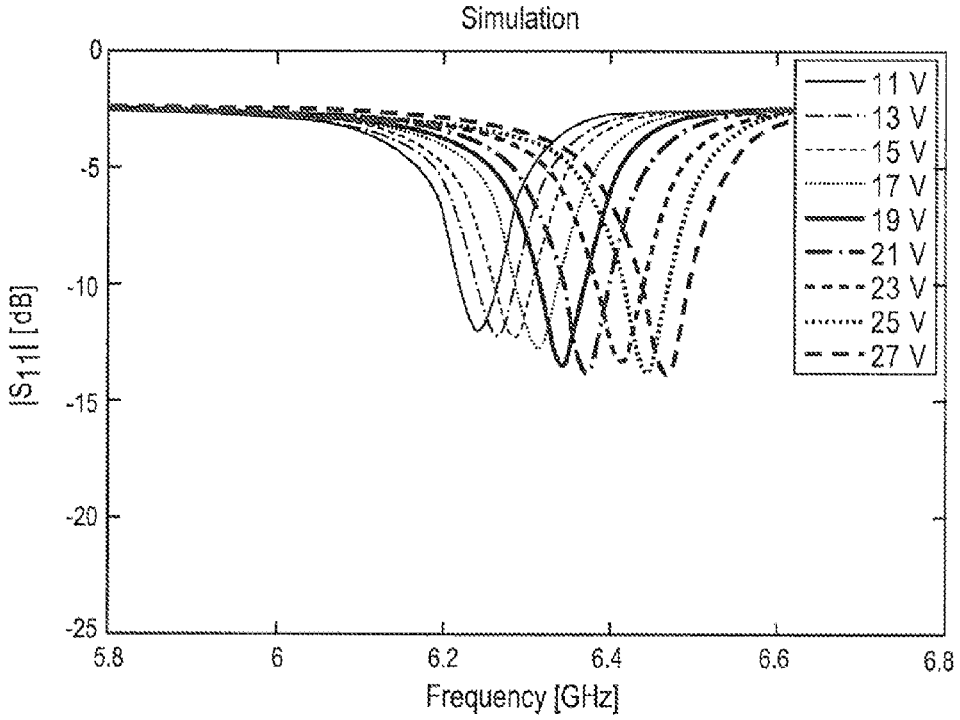
FIGS. 3A and 3B illustrate bandpass frequency graphs based on simulated and measured data, according to various embodiments.
Figure 3B:
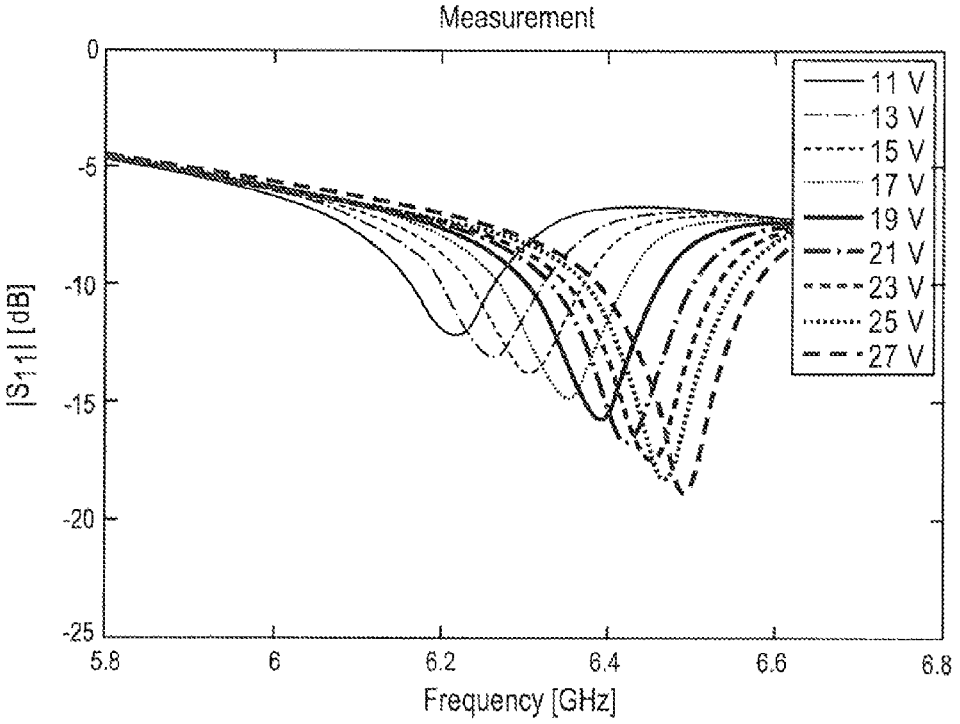
Figure 4:
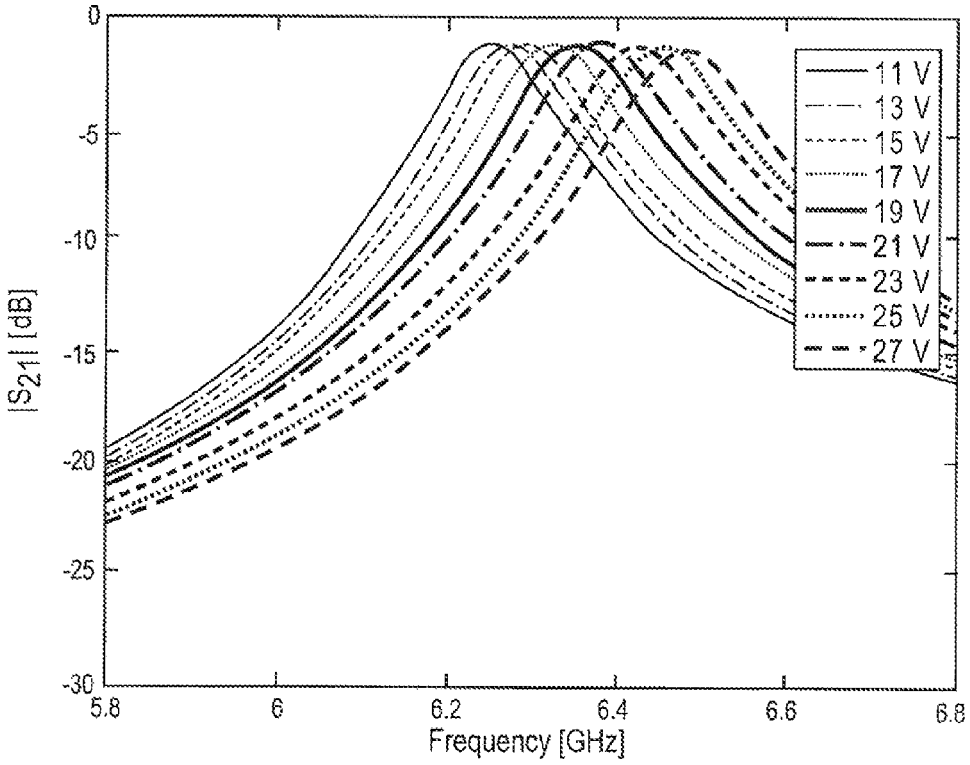
FIG. 4 illustrates a transmission characteristic of the filtenna device using simulated data, according to various embodiments.

The simulated and the measured |S11| (dB) of the filter structure 100 for different voltage levels (11 V-27 V) are shown in FIGS. 3A and 3B, respectively. From this plot, it can be concluded that the filter structure 100 acts as a re-configurable band-pass filter for different voltage values (different adjusted capacitances). The filter structure 100 can thus be used to reconfigure the operating frequency of an antenna structure of a smart phone, or other wireless device. The measured data of the filter structure 100 shows an illustrative tuning range from 6.16 GHz to 6.6 GHz. The tuning in the operating band of the structure is due to the change in the total capacitance of the filter structure 100, and this is achieved by adjusting the varactor 108 that resides in the middle of the microstrip line 132 of the filter structure 100. It will be noted, however, that the filter structure 100 can tune over a wider band of frequency as desired, using higher or lower capacitance values. As shown in FIG. 4, the insertion loss of the filter (|S21| (dB)) for different voltage levels is almost −1.5 dB. From this plot, one notices that the filter structure 100 provides very adequate out-of-band rejection performance for cellular or other wireless applications. While illustrated as a band-pass filter, it will be noted that filter structure 100 can be implemented as other band-limited filters, such as a band-stop filter.

Figure 5A:
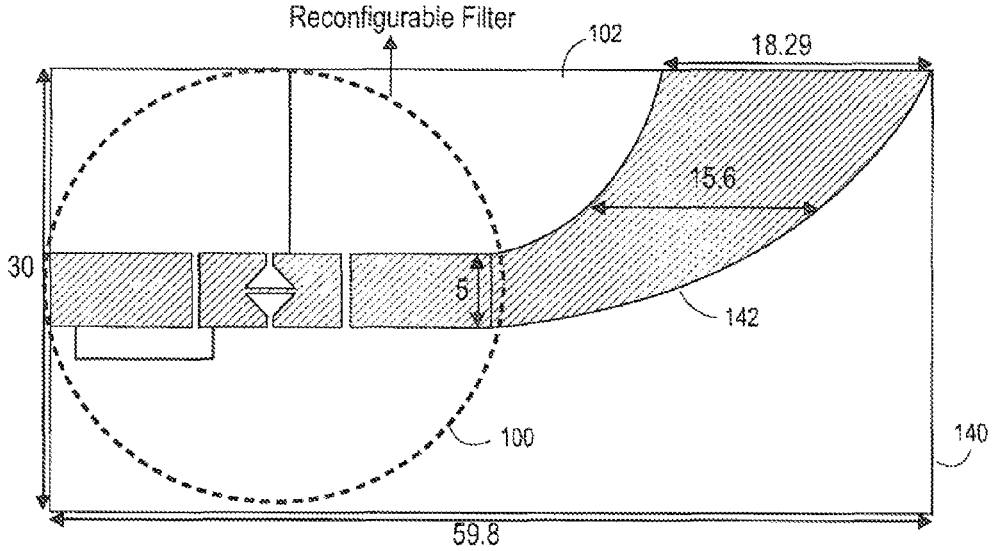
FIGS. 5A and 5B illustrate a top layer and bottom layer of the filtenna device, according to various embodiments.
Figure 5B:
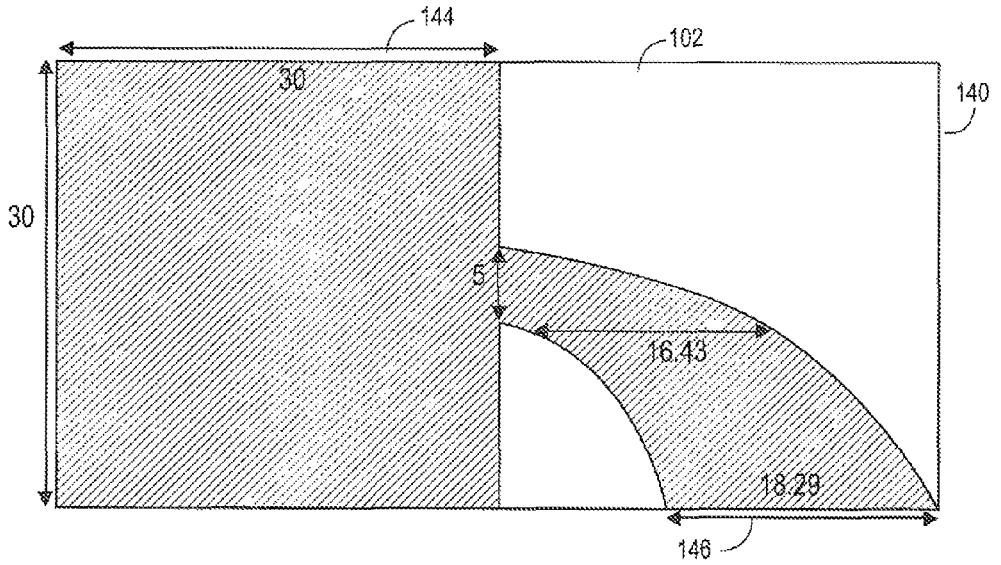

In terms of incorporation into a completed RF antenna assembly, as shown in FIGS. 5A and 5B, the overall filtenna structure 140 incorporating the tunable filter structure 100 can in implementations consist of a dual-sided Vivaldi antenna, which in general is a wideband structure and a reconfigurable band-pass filter. The filtenna structure 140 can be fed via a 50 ohms microstrip feeding line 132 which corresponds to a width of 5 mm. The Filtenna is made frequency reconfigurable by incorporating the band-pass filter structure 100 discussed above directly or integrally in the antenna microstrip feeding line 132. The technique of implementing an overall reconfigurable filtenna structure 140 provides multiple advantages in comparison with the conventional approach of switch incorporation into the antenna radiating patch. In fact, the negative effects of the biasing lines on the antenna behavior are minimized since they no longer reside in the radiating surface of the antenna. Also, by tuning the operating frequency of the filter structure 100, the filtenna structure 140 is able to maintain the same radiation pattern and a constant gain since the Filtenna surface's current distributions are not disrupted.

The top and bottom layers of the filtenna structure 140 are shown in FIGS. 5A and 5B, respectively. The filtenna structure 140 has a partial ground in the bottom layer, as shown in FIG. 5B. This ground plane 144 of the filtenna structure 140 has illustrative dimensions of 30 mm×30 mm. The structure can for instance be printed on a Taconic TLY substrate of dimension 59.8 mm×30 mm. The inner and outer contours of the antenna radiating surface are designed based on an exponential function. The top layer contains a top side antenna radiating surface 142, as well as the microstrip feeding line 132 where the reconfigurable filter structure 100 is located. On the bottom layer of the design resides the ground plane 144 of the filtenna structure 140, connected to the second (bottom) radiating part 146 of the Vivaldi antenna. While a Vivaldi type radiating antenna is illustrated as the radiating element in the filtenna structure 140, it will be appreciated that in implementations, other types or constructions of the radiating element can be used for different purposes.

Figure 6A:
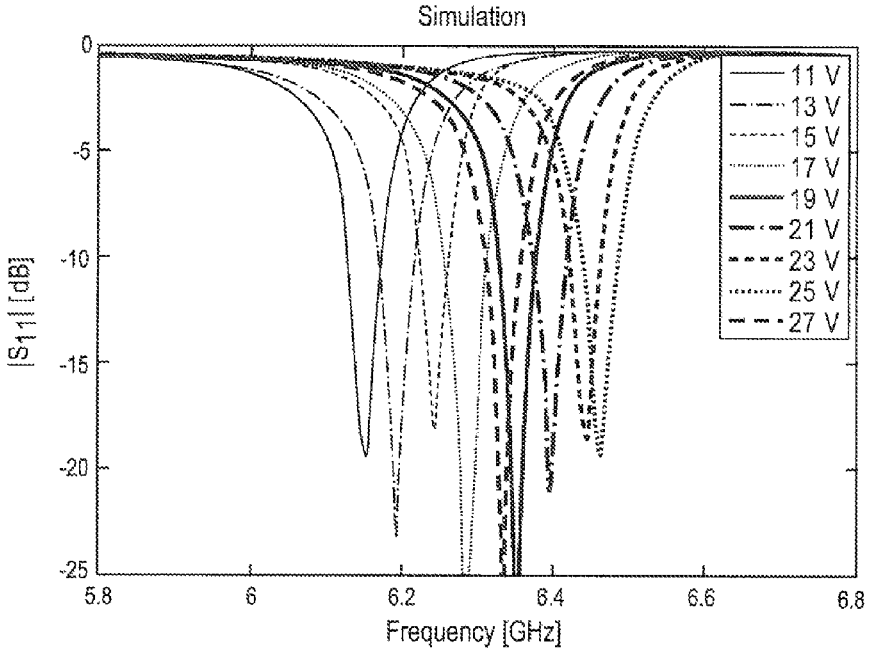
FIGS. 6A and 6B illustrate reflection coefficient graphs for the reconfigurable filtenna, using simulated and measured data, according to various embodiments.
Figure 6B:
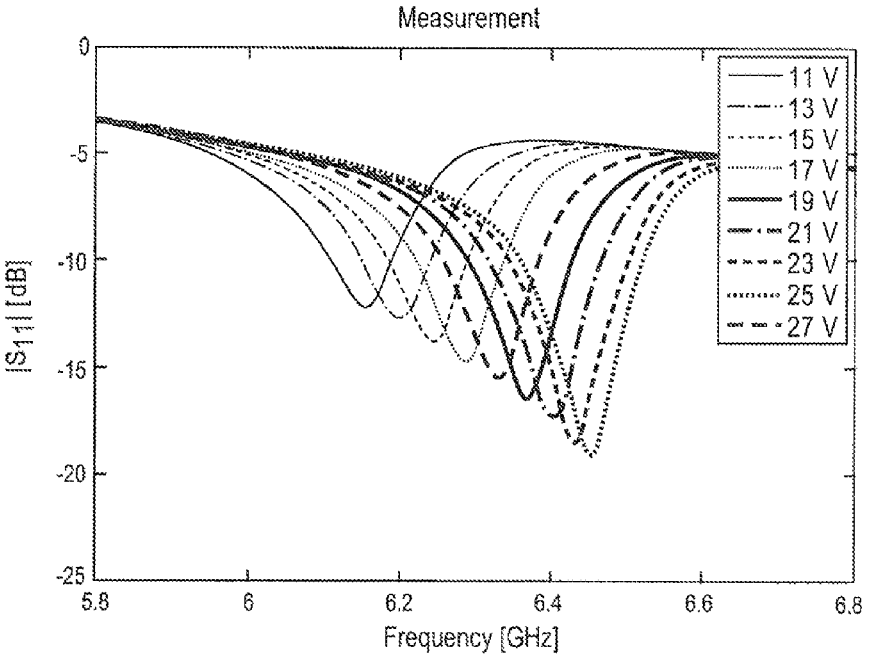

In terms of the reflection coefficient characteristics, the simulated and the measured filtenna reflection coefficients are shown in FIGS. 6A and 6B, respectively. The filtenna structure 140 is able to tune its operating frequency based on the mode of operation of the integrated filter structure 100. It may be noted that based on both simulated and measured data, the filtenna structure 140 produces a reflection coefficient above −10 dB outside the operating bandwidth of the filter structure 100. It will be noted that the tuning in the operating frequency of the filtenna structure 140 is achieved by using the same voltage characteristics as with the tuning of the filter structure 100.

Figure 7A:
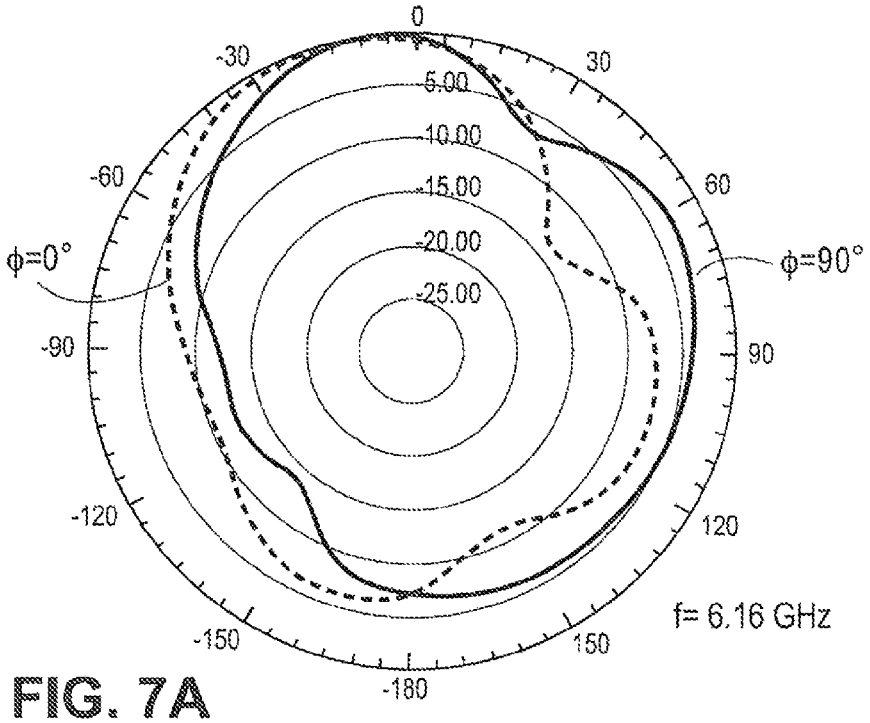
FIGS. 7A and 7B illustrate filtenna radiation pattern graphs at different operation frequencies, according to various embodiments.
Figure 7B:
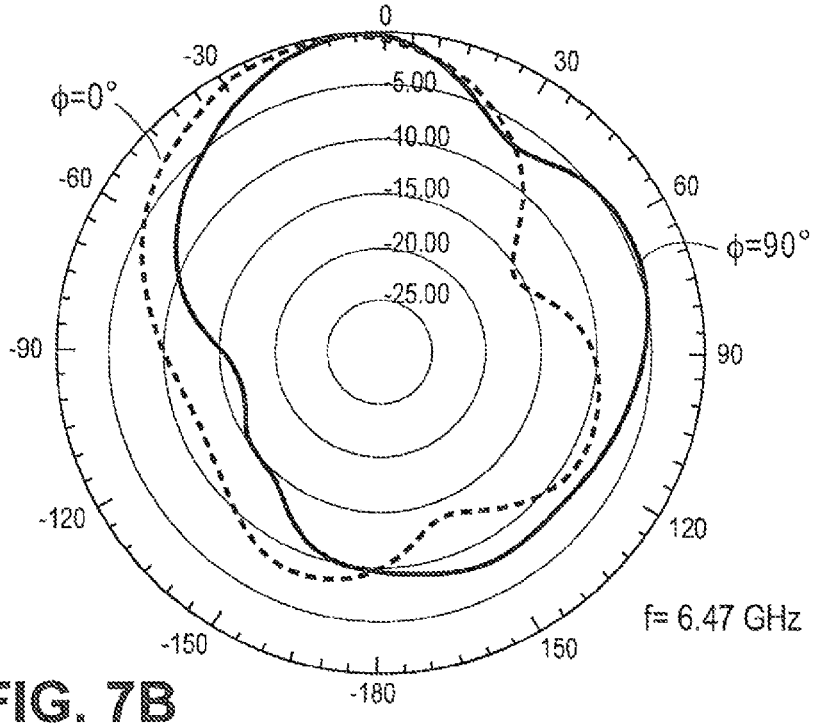

In terms of radiation patterns, FIG. 7 shows the normalized total radiated electric field at f=6.16 GHz (11 V) and f=6.47 GHz (27 V) in the $\phi=0°$ and $\phi=90°$ planes. The Filtenna radiation pattern remains almost the same for the different voltage levels. The Filtenna gain at $\theta=0°$ and $\phi=0°$ is 5.72 dB (6.17 GHz) and 6.77 dB (6.47 GHz), respectively.

The foregoing description is illustrative, and variations in configuration and implementation may occur to persons skilled in the art. For example, while embodiments have been described in which the filter structure 100 interacts with one radiating element in the overall filtenna structure 140, it will be appreciated that in implementations, multiple radiating elements and/or filtennas, for example for diversity purposes, can be used. Other resources described as singular or integrated can in embodiments be plural or distributed, and resources described as multiple or distributed can in embodiments be combined. The scope of the present teachings is accordingly intended to be limited, only by the following claims.

What is claimed is:

1. A reconfigurable filtering antenna (filtenna) structure, comprising:

a reconfigurable band-limited filter, the reconfigurable band-limited filter comprising:

a first port to receive a radio frequency (RF) signal and a biasing DC signal, a microstrip feeding line configured to receive the RF signal and the biasing signal, the microstrip feeding line comprising a first edge section, a middle section, and a second edge section, wherein the first edge section and the middle section is separated by a first cap and the middle section and the second edge section is separated by a second gap, wherein the first gap and the second gap contribute to a fixed capacitance of the microstrip feeding line, wherein the first edge section and the middle section is electrically connected, and a varactor, incorporated within a slot in the middle section; and an antenna element, operatively integrated with the reconfigurable band-limited filter, wherein the reconfigurable band-limited filter performs in a band-limited operation based on the biasing DC signal applied to the varactor, wherein the biasing DC signal changes a total capacitance of the filtenna structure.

2. The filtenna structure of claim 1, wherein the reconfigurable band-limited filter is integrally formed on the same substrate as the antenna structure.

3. The filtenna structure of claim 2, wherein the varactor is grounded to a ground connection of the substrate.

4. The filtenna structure of claim 1, wherein the RF signal and the biasing DC signal are received at the first port via a bias tee circuit, the first port being connected to the microstrip feeding line.

5. The filtenna structure of claim 1, wherein the antenna element comprises a dual sided Vivaldi antenna.

6. The filtenna structure of claim 5, wherein the dual sided Vivaldi antenna element comprises a top layer, and the reconfigurable band-pass filter is formed on the top layer.

7. The filtenna structure of claim 5, wherein the dual sided Vivaldi antenna element comprises of a ground plane opposite to the top layer.

8. The filtenna structure of claim 1, wherein the band-limited filter is tunable.

9. The filtenna structure of claim 8, wherein the band-limited filter comprises a band-pass filter.

10. The filtenna structure of claim 8, wherein the band-limited filter comprises a band-stop filter.

11. The filtenna structure of claim 1, wherein the slot comprises a hexagonal slot.

12. A wireless device, comprising:

a reconfigurable filtering antenna (filtenna) structure, comprising— a reconfigurable band-limited filter, the reconfigurable band-limited filter comprising:

a first port to receive a radio frequency (RF) signal and a biasing signal, a microstrip feeding line configured to receive the RF signal and the biasing signal, the microstrip feeding line comprising a first edge section, a middle section, and a second edge section, wherein the first edge section and the middle section is separated by a first gap and the middle section and the second edge section is separated by a second pap, wherein the first gap and the second gap contribute to a fixed capacitance of the microstrip feeding line, wherein the first edge section and the middle section is electrically connected, and a varactor, incorporated within a slot in the middle section;

an antenna element, operatively integrated with the reconfigurable band-limited filter, wherein the reconfigurable band-limited filter performs in a band-limited operation based on the biasing DC signal applied to the varactor, wherein the biasing DC signal changes a total capacitance of the filtenna structure, a transceiver element, operatively connected to the first port, the transceiver element being configured to transmit and receive the RF signal via the filtenna structure.

13. The wireless device of claim 12, wherein the reconfigurable band-limited filter is integrally formed on a same substrate as the antenna structure.

14. The wireless device of claim 13, wherein the varactor is grounded to a ground connection of the substrate.

15. The wireless device of claim 12, wherein the band-limited filter comprises a band-pass filter.

16. The wireless device of claim 12, wherein the slot comprises a hexagonal slot.

* * * * *